United States Patent [19]

Jarnagin et al.

[11] Patent Number: 4,798,034

[45] Date of Patent: Jan. 17, 1989

[54] METHOD AND APPARATUS FOR COLLECTING AND DISCHARGING RADON GAS AND FLUIDS

[75] Inventors: Jerry D. Jarnagin; Dennis W. Dawson, both of Canton, Ill.

[73] Assignee: Safe Aire, Inc., Canton, Ill.

[21] Appl. No.: 3,138

[22] Filed: Jan. 14, 1987

[51] Int. Cl.[4] ..... E02D 19/00

[52] U.S. Cl. ..... 52/169.5; 52/741

[58] Field of Search ..... 52/169.5

[56] References Cited

U.S. PATENT DOCUMENTS 3,344,569 10/1965 Cotten .
4,198,794 4/1980 Younts, Jr. ..... 52/169.5
4,391,071 7/1983 Schantz ..... 52/169.5

OTHER PUBLICATIONS

"Radon Reduction Methods: A Homeowner's Guide," Environmental Protection Agency, Aug. 1986 (OPA-8-6-005).

"Radon Reduction Techniques for Detached Houses: Technical Guidance, " Environmental Protection Agency, Jun. 1986 (EPA/625/5-86/019).

*Primary Examiner*—Carl D. Friedman

*Attorney, Agent, or Firm*—Bell, Seltzer, Park & Gibson

[57] ABSTRACT

This invention relates to an apparatus and method for collecting radon gas and fluids primarily from the periphery of a subterranean enclosure and for discharging the collected fluids and radon gas to the exterior of the enclosure. The apparatus and method create a sealed system around the inside perimeter of the subterranean enclosure. A lower than ambient air pressure created in the system collects the radon gas and fluids therein. The radon gas and fluids separate and the system disposes of them separately.

20 Claims, 2 Drawing Sheets

METHOD AND APPARATUS FOR COLLECTING AND DISCHARGING RADON GAS AND FLUIDS

FIELD OF THE INVENTION

This invention relates generally to the collection and removal of radon gas and fluids from basements or other enclosures to minimize any health hazards and destruction of property. More specifically it relates to a system which simultaneously vents radon gas and drains fluids.

BACKGROUND OF THE INVENTION

Radon gas is a significant health hazard that has only relatively recently been recognized as causing up to 20,000 deaths each year in the United States alone. The United States Environmental Protection Agency has estimated that one million to five million homes may have unhealthful radon levels. In non-inhabited areas, radon gas naturally diffuses through the soil into the atmosphere where it is harmlessly dispersed. Wherever there is a house, however, the radon gas leaks into subterranean rooms around the foundation slab and through cracks in the foundation or subterranean walls, and diffuses through porous cement and concrete blocks. And, since radon is heavier than air, the subterranean room acts as a collector of radon gas, holding and concentrating the gas to lethal levels.

The Environmental Protection Agency has published A HOMEOWNER'S GUIDE, August, 1986, OPA-86-005, and a TECHNICAL GUIDANCE Manual, EPA/625/5-86/019, that outline methods for reducing radon gas concentrations inside subterranean rooms of houses. These pamphlets discuss the method of using a drainage tile system located outside the house to collect and discharge radon gas and water, but this system is very expensive and there is no disclosure of how the system may be used inside the house. The pamphlets also discuss an inside baseboard system to collect and exhaust radon gas, but there is no disclosure that the baseboard system can collect and discharge both radon gas and fluids. It is also the experience of those individuals in the field that existing baseboard systems that collect and vent radon gas cannot also collect and discharge fluids, due in part to the pressures exerted by the fluid on the collection system. There is no suggestion in the literature that any inside collecting and venting apparatus has been or could be used to collect and drain both fluids and radon gas.

The leakage of water into subterranean rooms results in destructive damage to furniture, wall coverings, structural supports, upholstery, equipment, and other items. A moist or wet room may also result in health problems that can cause a room to be uninhabitable. Even rooms that are normally dry and comfortable may be flooded after especially wet conditions like a heavy rainfall.

U.S. Pat. No. 3,344,569 to Cotten discloses a basement drain conduit that overlies the basement floor and wall. It is designed to drain water that seeps into a basement, but it is not an airtight system. Indeed, the Cotten patent touts as one of its major advantages access to the interior of the conduit so that sediment may be removed. This results in an unsealed and open system. Cotten also provides multiple open drains or open sumps to collect and dispose of excess water. Because the drain system is not sealed, any dangerous gases will escape from the collection system and, moreover, exacerbate the problem of admitting lethal radon gas into the room. There is no suggestion that the system will work to discharge gases, nor is there a disclosure that the system can be or was intended to be used to discharge both radon gas and fluids.

SUMMARY OF THE INVENTION

Accordingly, it is an object of the present invention to overcome the limitations and disadvantages of the prior art.

It is another object of the present invention to provide a method and apparatus for collecting and discharging both radon gas and fluids.

It is another object of the present invention to provide a method and apparatus for collecting radon gas and fluids from zones outside a subterranean enclosure and discharging them before they accumulate in the enclosure.

It is another object of the present invention to provide a method and apparatus that drains collected fluid from the lower portion of the collecting means and draws the collected radon gas from the top of the collecting means.

Other objects and advantages of the present invention will become apparent upon reading the following detailed description and appended claims, and upon reference to the accompanying drawings.

The present invention overcomes the drawbacks of the systems taught by the prior art with a method and apparatus for collecting both radon gas and fluids and discharging them. The apparatus comprises means for collecting the radon gas and fluids from zones outside a subterranean enclosure. Means for creating a low air pressure in the collecting means draws the radon gas into the collecting means and vents it outside the enclosure. Means for draining the fluid also dispose of it outside the enclosure. The invention also includes a method for collecting and disposing of both radon gas and fluids.

DESCRIPTION OF THE DRAWINGS

For a more complete understanding of this invention reference should now be had to the embodiments illustrated in greater detail in the accompanying drawings and described below by way of examples of the invention. In the drawings.

While the invention will be described in connection with a preferred embodiment, it is not intended to limit the invention to that embodiment. On the contrary, all alternatives, modifications and equivalents are to be included within the spirit and scope of the invention as defined by the appended claims.

DESCRIPTION OF THE PREFERRED EMBODIMENT

Figure 1:
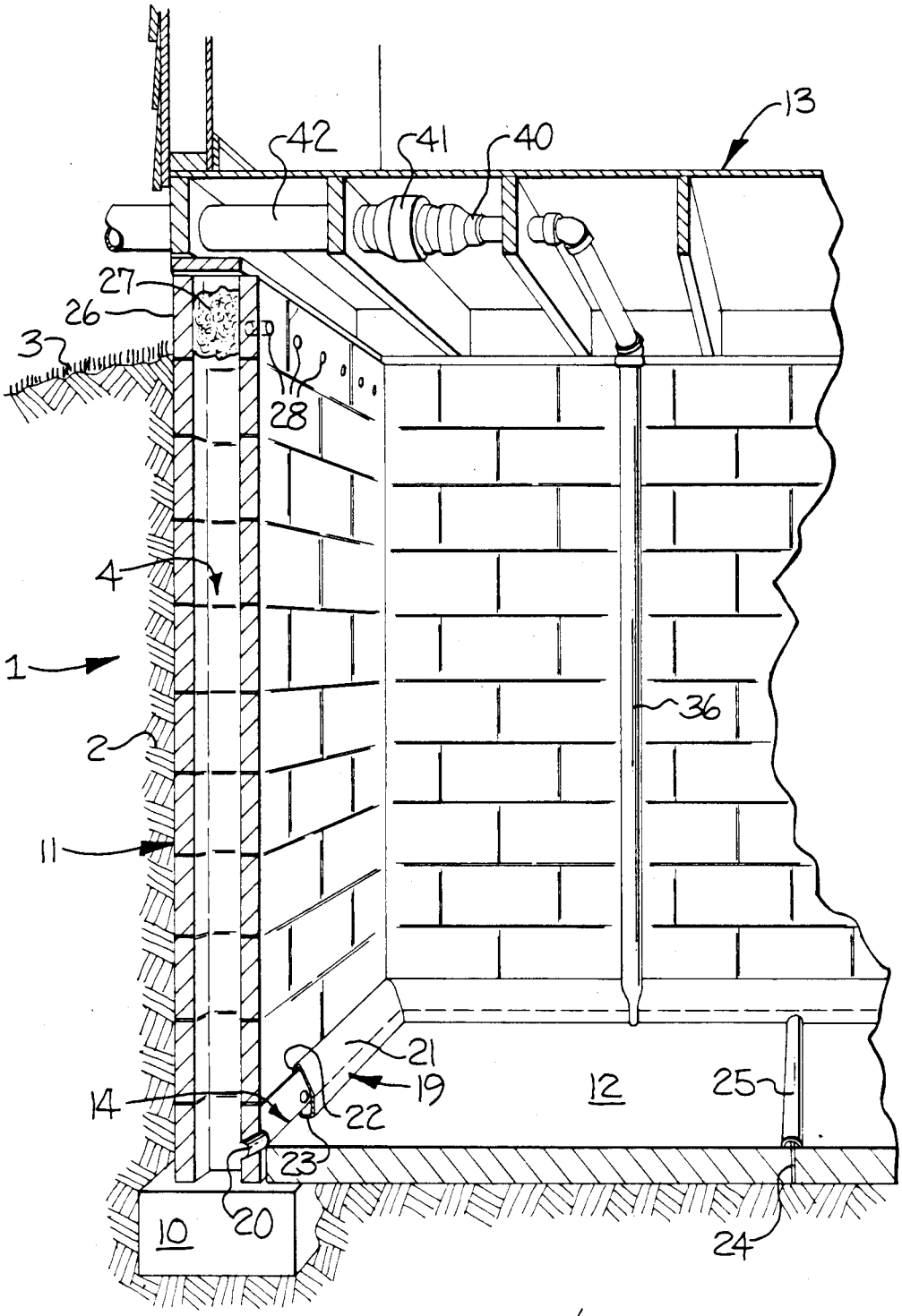
FIG. 1 is a perspective view of a section of a subterranean enclosure.

Turning to FIG. 1, the subterranean enclosure 1, such as the basement illustrated as the preferred embodiment, is surrounded by earth 2 through which radon gas and fluids naturally diffuse.

There is shown a foundation footing 10 of concrete or the like which supports a hollow concrete block wall 11. Four such walls define the perimeter of the subterranean enclosure, and two of them are shown in this illustration. The hollow block walls extend from the foundation footings on which they rest to at least some level above the top ground level 3. In addition to defining a vertical wall, the hollow blocks are preferably stacked with their interior hollow cores aligned, defining adjacent vertical passageways 4 that extend from the top to the bottom of the wall. Alternatively, the interior hollow cores may not be aligned, or the wall may be made of poured concrete or other suitable material.

Also resting on the foundation footings is a poured concrete floor slab 12 that forms the floor of the subterranean enclosure. The floor slab should rest on the foundation footings immediately next to the hollow block wall. As may sometimes happen, however, the floor slab may rest on the ground immediately next to the footing. Preferably, the floor is nonpermeable to gas and fluid.

The zone proximate the footing 10 where the wall and floor meet is referred to as the junction region 14, and it extends around the entire perimeter of the enclosure.

The subterranean enclosure is typically covered by a ceiling 13. It may consist of floor beams or joists and sub-flooring that support the ground floor of a house.

A collecting means 19 is situated in the junction region inside the subterranean enclosure. The collecting means includes a plurality of holes or conduits 20 around the perimeter of the enclosure. Each conduit 20 extends from a predetermined zone outside the enclosure to the junction region that is inside the enclosure, and permits the passage of gas and fluids from the zone outside the enclosure through the junction region to the inside of the enclosure. For hollow block walls the conduit may extend from the junction region to the block passageways. For solid walls the conduit may extend from the junction region through the wall.

A baseboard 21 has its upper portion 22 sealed to the inside surface of the wall at a level above the interior openings of the conduits, and its lower portion 23 sealed to the inside surface of the floor a small distance from the intersection of the hollow block wall and floor slab or foundation footing and floor slab. The baseboard is impervious to radon gas and fluids and is sealed to the wall and floor so that radon gas and fluids collected at the junction region cannot seep around the baseboard or escape from behind the baseboard into the enclosure. The baseboard extends around the entire inside perimeter of the enclosure, forming a collector that is in communication with all of the conduits. It may be made of a flexible vinyl material, and may be bonded to the floor and walls with a sealing adhesive, such as expoxy.

The collecting means may be extended to seal additional openings 24 in the floor or walls beyond the junction region. For example, an extension conduit 25, having substantially the same characteristics as the baseboard 21, is sealed over a crack, junction or other opening in the wall or floor. One end of the extension is sealed to and in communication with the baseboard, and the distal end is sealed shut, providing an air tight and fluid tight extension that is a part of the collecting means.

A gas venting pipe 36 is sealed to and in communication with at least the upper portion of the baseboard collecting means. The gas venting pipe extends upwardly from the top of the baseboard to the suction side 40 of a fan 41. The exhaust side of the fan is connected to the outside by an exterior venting pipe 42. The fan may be located outside, or the vent pipe may be used without a fan. Such modifications may be made as necessary or desirable, depending upon the particular situation.

The upper portion 26 of the passageways 4 in the hollow block wall are sealed with a filler 27 that is impervious to radon gas, thus forming chambers in the hollow block walls that extend from the footing upward to the filler 27. The filler may be injected through holes 28 drilled at the top of the wall, or by any other desireable method. In conjunction with the conduits 20, the sealed passageways 4 are thus connected directly to the collecting means or baseboard 21. This enhances the ability of the collecting means to capture radon gas that would otherwise diffuse through the walls into the basement enclosure.

Figure 2:
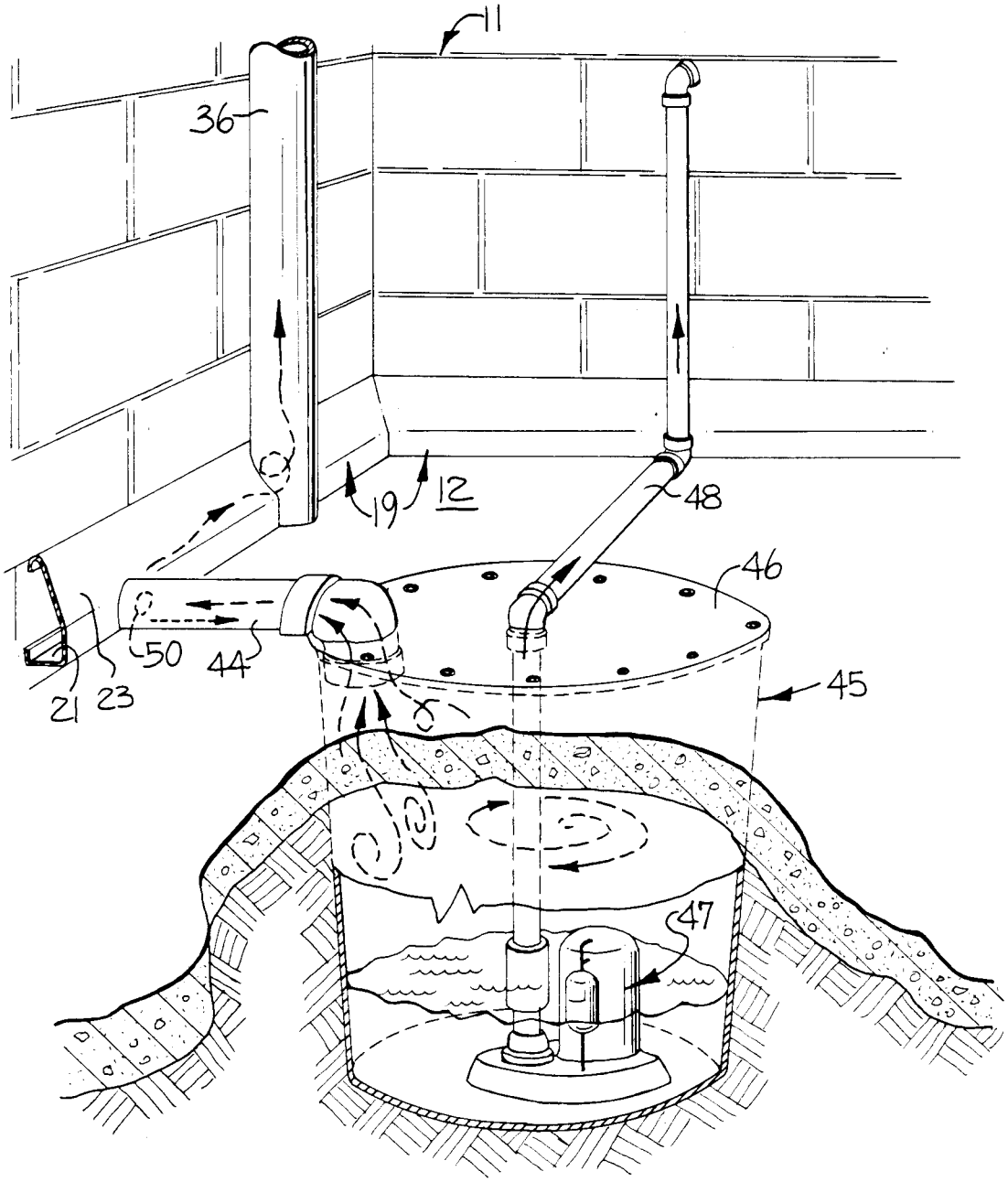
FIG. 2 is a perspective view of a portion of a subterranean enclosure and a section of one embodiment of a fluid sump.

Referring now to FIG. 2, the walls 11, floor 12, baseboard 21 and venting pipe 36 are as shown in FIG. 1. Also illustrated is that portion of the apparatus for collecting and discharging fluids.

One end of a drain connector pipe 44 is sealed to and in communication with at least the lower portion 23 of the baseboard collecting means via an opening 50 in the baseboard. The drain connector pipe extends from the bottom of the baseboard collecting means to the top of a sealed sump or well 45 set in the floor 12 for collecting drained fluids, and the other end of the drain connector pipe is sealed to and in communication with the interior of the well. A lid 46 that is impervious to radon gas and fluids is sealed to the top of the well. There is a gas tight and fluid tight seal between the floor 12 and the lid 46. Alternatively, the well may be outside the enclosure, with the drain connector pipe extending outside of the enclosure.

Inside the well 45 is a fluid pump 47 for removing fluid that drains into and collects in the well. The fluid pump is connected to a fluid removal pipe 48 that carries the pumped fluids to the exterior of the enclosure.

Radon gas and fluids will naturally flow into the subterranean enclosure 1 by diffusing through the hollow block wall 11 or floor slab 12. They seep through openings 24 or cracks in the wall or floor into the enclosure. They also seep through the junction region 14 around the foundation footing 10, wall 11, and floor 12 into the enclosure.

Assuming that the collection and discharge apparatus of the present invention has been installed, the fan draws a suction through the gas venting pipe, creating a low pressure condition within the collecting means 19. This low pressure also extends through the conduit 20 to the zones outside the enclosure where the opposite end of the conduit is located. And, if the conduit ends in the passageway 4 of a hollow block wall, the entire passageway functions as an extension of the collecting means to draw in radon gas, especially if the upper portion of the wall is sealed by injecting filler 27 into the block passageway at some point near or above ground level. In the illustrated embodiment the low pressure condition also extends to the well 45 because it is in sealed communication with the baseboard 21. Thus, due to this low pressure condition, any radon gas proximate the zones outside the enclosure, or tending to leak in through walls, cracks, floors, sumps, etc. is collected and exhausted to the outside.

Any fluids having sufficient hydrostatic pressure to reach the conduits or leak into the enclosure through sealed cracks or the junction are contained by the sealed collection system. This may be rain water or ground water that has exceeded its usual levels. All of the fluids collect in the collecting means and flow through the drain connector pipe 44 via gravity into the well 45 where the fluids collect again. When the fluids comprise some predetermined amount, the fluid pump 47 disposes of the fluid by pumping the fluid through the fluid removal pipe 48 to the exterior. The invention will dispose of both radon gas and fluids by drawing the gas from the upper portion of the collecting means, and permitting the water to flow out the lower portions of the collecting means.

The invention has been described in detail with particular reference to a preferred embodiment and the operation thereof, but it is understood that variations, modifications, and the substitute of equivalent mechanisms can be effected within the spirit and scope of this invention, particularly in light of the foregoing teachings.

That which is claimed is:

1. Apparatus for collecting gas and fluids from the periphery of a subterranean enclosure having walls and a floor defining a junction region therebetween and for discharging the collected gas and fluids outside the enclosure, the apparatus comprising:

(a) collecting means disposed within the enclosure for collecting gas and fluids from predetermined zones outside the enclosure, said means being impervious to gas and fluids and defining a plurality of conduits in communication with said predetermined zones outside the enclosure, said means being generally disposed at the junction region;

(b) means for creating a lower than ambient air pressure in said collecting means so that gas and fluids have a tendency to flow from the predetermined zones outside the enclosure through the conduits and into the collecting means, and for venting the gas outside the enclosure; and (c) means for draining the collected fluid from the collecting means and for disposing of the fluid.

2. Apparatus as in claim 1 wherein the means for collecting comprises means for forming a gas tight and fluid tight seal with the enclosure between the wall and floor thereof.

3. A apparatus as in claim 1 wherein the means for collecting further comprises means extending beyond the junction and forming a gas tight and fluid tight seal over an opening in the floor or a wall beyond the junction thereof.

4. Apparatus as in claim 1 wherein the means for collecting comprises a baseboard having one edge sealed to floor and one edge sealed to wall.

5. Apparatus as in claim 1 wherein the means for collecting comprises means disposed around substantially the entire interior of the enclosure.

6. Apparatus as in claim 1 wherein the means for collecting comprises flexible material.

7. Apparatus as defined in claim 1 wherein the means for venting the gas comprises a gas venting pipe sealed to the collecting means and extending upwardly for removing gas from the collecting means.

8. Apparatus as defined in claim 1 wherein the means for creating a low air pressure comprises a fan having a suction side connected to the collecting means and an exhaust side connected to the outside.

9. Apparatus as defined in claim 1 wherein the means for venting the gas and for creating a low air pressure comprises a gas venting pipe sealed to the collecting means and extending upwardly and connected to the suction side of a fan having an exhaust side connected to the outside.

10. Apparatus as defined in claim 1 wherein the means for draining the collected fluid comprises a gas tight fluid sump and means for connecting the collecting means to the fluid sump for removing the fluid from the collecting means.

11. Apparatus as defined in claim 10 wherein the sump comprises a well in the floor of the enclosure to collect fluid from at least the collecting means, a lid over said well that is impervious to radon gas, and a gas tight seal between the floor and said lid.

12. Apparatus as defined in claim 1 wherein the means for draining the collected fluid comprises a fluid pump.

13. Apparatus of claim 1 wherein the enclosure includes hollow block walls and wherein the collecting means further comprises means sealing the upper portion of the hollows of the block walls, forming chambers therein, and a gas tight conduit connecting the chambers of the block walls to the collecting means so that any gas or fluid in the chambers have a tendency to flow into the collecting means.

14. A method for collecting radon gas and fluids from the periphery of a subterranean enclosure having walls and a floor defining a junction region therebetween and for discharging the collected gas and fluids outside the enclosure, the method comprising the steps of (a) forming a plurality of conduits proximate the junction permitting the flow of gas and fluids from predetermined zones outside the enclosure through the conduits and into the enclosure;

(b) creating a lower than ambient air pressure within a collecting means disposed inside the enclosure that is in communication with the formed conduits so that gas and fluids have a tendency to flow into the collecting means from the predetermined zones outside the enclosure;

(c) draining the fluid that has flowed into the collecting means; and (d) exhausting the gas that has flowed into the collecting means.

15. The method of claim 14 wherein the step of forming a plurality of conduits comprises forming a plurality of apertures extending from predetermined zones outside the enclosure through the junction region and into the enclosure, and interconnecting the formed apertures with a collecting means.

16. The method of claim 15 wherein the collecting means comprises a baseboard being impervious to gas and fluids, and the step of interconnecting the formed apertures comprises forming a gas tight and fluid tight seal with the baseboard between the floor and walls in the junction region.

17. The method of claim 14 wherein the step of creating a lower than ambient air pressure comprises drawing a suction on the collecting means.

18. The method of claim 14 wherein the step of draining the fluid comprises separating the collected fluid from the collected gas by draining the collected fluid from the lower portions of the collecting means.

19. The method of claim 14 wherein the step of exhausting the gas comprises separating the collected gas from the collected fluid by drawing the collected gas from the upper portions of the collecting means.

20. The method of claim 14 wherein the enclosure includes hollow block walls and wherein the step of forming a plurality of conduits additionally comprises sealing the upper portion of the hollows of the block walls, forming chambers therein.

* * * * *